US006834828B1

(12) United States Patent
Tritt

(10) Patent No.: US 6,834,828 B1
(45) Date of Patent: Dec. 28, 2004

(54) FIN DEPLOYMENT SYSTEM

(75) Inventor: Benjamin R. Tritt, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/670,098

(22) Filed: Sep. 23, 2003

(51) Int. Cl.[7] ..... F42B 10/00

(52) U.S. Cl. ..... 244/3.27; 244/3.28; 244/3.29; 102/384

(58) Field of Search ..... 244/3.27, 3.28, 244/3.29; 102/384

(56) References Cited

U.S. PATENT DOCUMENTS

| | | | | |
|---|---|---|---|---|
| 4,709,877 A | * | 12/1987 | Goulding | 244/3.28 |
| 4,736,909 A | | 4/1988 | Boder et al. | 244/3.29 |
| 4,796,835 A | | 1/1989 | Galvin | 244/3.29 |
| 4,838,502 A | | 6/1989 | Pinson | 244/49 |
| 5,085,381 A | | 2/1992 | Spiroff et al. | 244/3.24 |
| 5,108,051 A | | 4/1992 | Montet et al. | 244/3.28 |
| 5,400,712 A | | 3/1995 | Herbage et al. | 102/361 |
| 5,480,111 A | | 1/1996 | Smith et al. | 244/3.27 |
| 5,762,294 A | * | 6/1998 | Jimmerson | 244/49 |
| 6,168,111 B1 | | 1/2001 | Kayser et al. | 244/3.29 |
| 6,260,798 B1 | * | 7/2001 | Casiez et al. | 244/49 |
| 6,435,097 B1 | | 8/2002 | Garner et al. | 102/490 |
| 6,454,205 B2 | | 9/2002 | Niemeyer et al. | 244/3.26 |
| 6,761,331 B2 | * | 7/2004 | Eisentraut et al. | 244/3.28 |

* cited by examiner

*Primary Examiner*—J. Woodrow Eldred
(74) *Attorney, Agent, or Firm*—Matthew J. Bussan, Esq.; Scott R. Boalick, Esq.

(57) ABSTRACT

Actuators already present as an integral part of the control systems of missiles and the like are used to activate and control the deployment of fins and the like without the need for separate explosively or mechanically driven fin deployment systems. Springs located in hinges on the fins accomplish the complete deployment of the fins after proper orientation by the actuators.

5 Claims, 6 Drawing Sheets

FIN DEPLOYMENT SYSTEM

FIELD OF THE INVENTION

The present invention relates to fin deployment systems and more particularly to such systems that are useful for guiding missiles and the like.

BACKGROUND OF THE INVENTION

Existing methods for the deployment of fins from ordnance such as missiles, smart bombs or any object that is moving through the air and requires fins (wings, canards, etc.) to be initially stored in position within the cylindrical restraints of the ordnance body may use explosive bolts to release a spring that pushes the fins from a folded to an open position. Other methods have also been used including a device that holds the fins in place until exposed to a high-G load caused by some event in the launching process, such as launching from a gun barrel. The complexity of existing systems such as explosive bolts or other explosively initiated devices or even separate mechanical systems (such as separate springs, retaining clips and the like) are well known to those skilled in the art and include among others: increased safety concerns (especially with explosive bolts); reliability (moving parts in mechanical systems); longevity; stability etc.

It would therefore be highly desirable to have a fin deployment system that did not rely upon a separate and somewhat marginally reliable explosively or mechanically driven system to achieve deployment of fins in missiles and the like.

OBJECTS OF THE INVENTION

It is therefore one object of the present invention to provide a fin deployment system that does not rely upon a separate explosively or mechanically driven system to achieve fin deployment in missiles or the like.

It is another object of the present invention to provide a fin deployment system that utilizes reliable existing systems that are already an integral part of the missile, smart bomb, etc. control system.

SUMMARY OF THE INVENTION

According to the present invention, actuators already present as an integral part of the flight control systems of missiles and the like are used to activate and control the deployment of fins and other similar steering devices without the need for separate explosively or mechanically driven deployment systems. Springs located in hinges in the fins accomplish the complete deployment of the fins after proper orientation by the actuators.

DETAILED DESCRIPTION

Actuators are small electric motors that position the fins of a missile or the like projectile in the required position for directing the flight of the projectile. Such devices are an integral part of the control loop for missile flight. Actuators are commonly used in guidance systems of missiles, smart bombs etc. are well known in the art and already incorporated into most aircraft, aerospace and missile and bomb systems. The reliability, durability and safety of such systems are well known and well recognized by those skilled in these related arts. Such devices are commercially available from suppliers such as Moog Inc, Jamison Road, East Aurora, N.Y. 14052 and Textron Systems, 201 Lowell Street, Wilmington, Mass. 01887.

Figure 11:
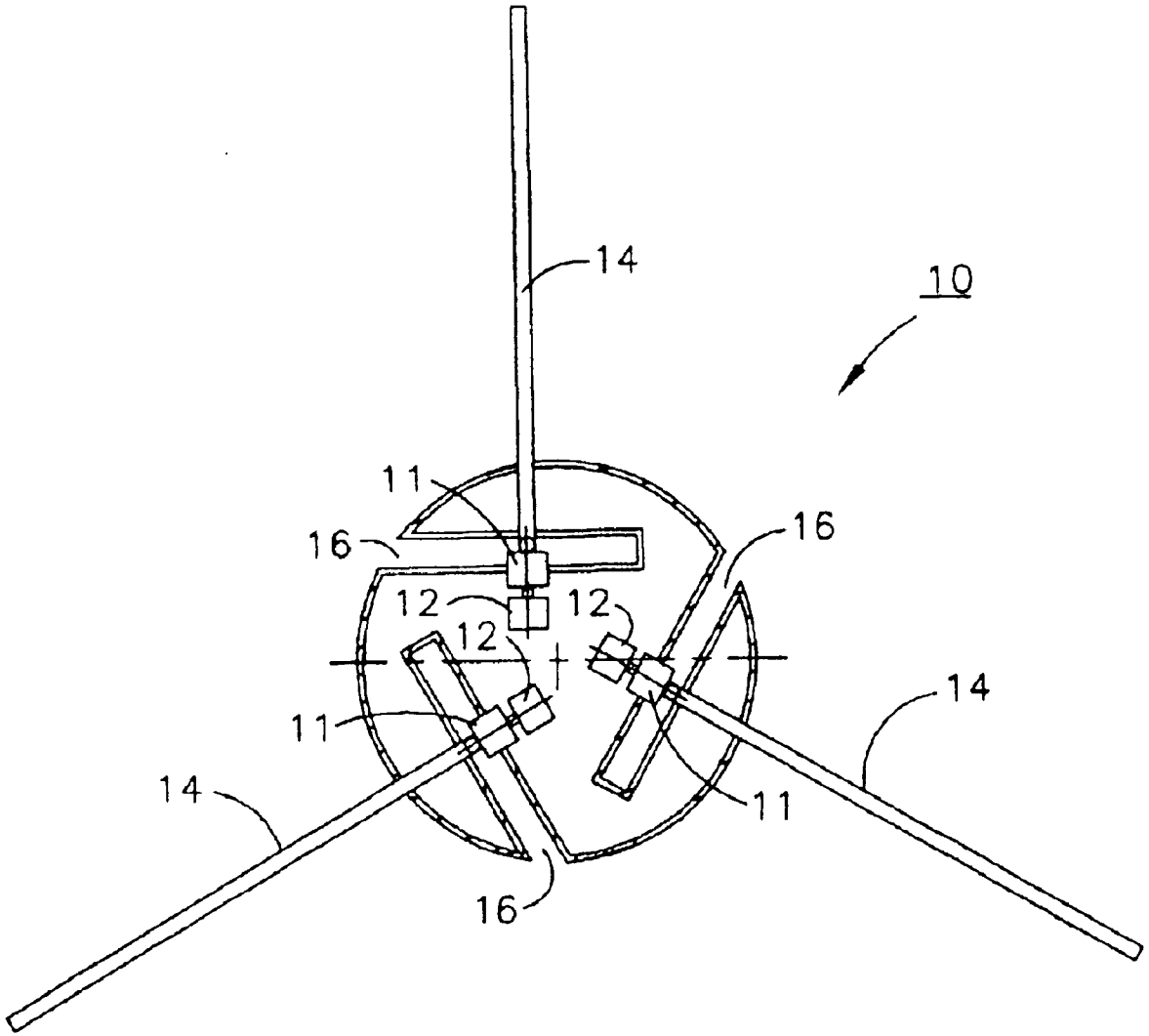
FIG. 11 is an end view of a missile showing a plurality of fins deployed through the use of the fin deployment system of the present invention.

In the following Figures, a single fin is depicted for simplicity, however it will be readily understood that a plurality of fins 14 are generally deployed about the periphery of body 18 of a missile or the like to impart proper guidance to missile 10 in flight. In conventional practice two to four fins of the type depicted in the accompanying Figures are generally used. Such an embodiment depicting three deployed fins is shown in FIG. 11.

Figure 1:
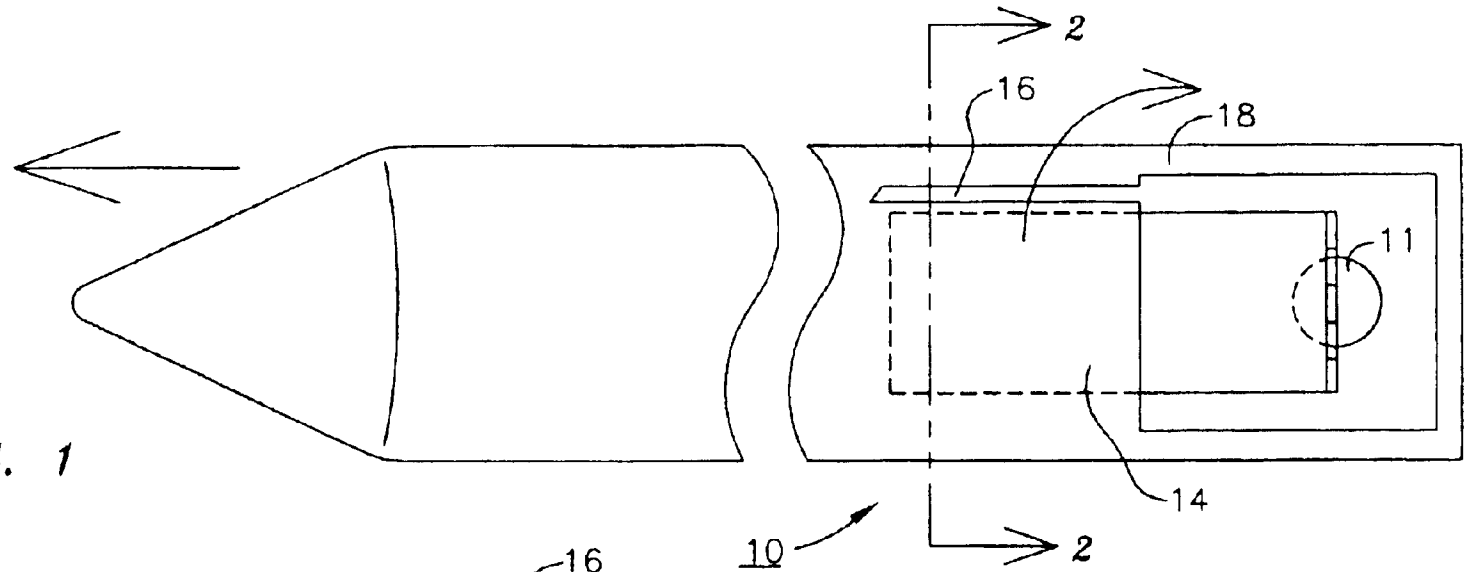
FIG. 1 is a partially phantom view of the fin deployment system of the present invention with the fins in the folded position within the body of the missile.
Figure 2:
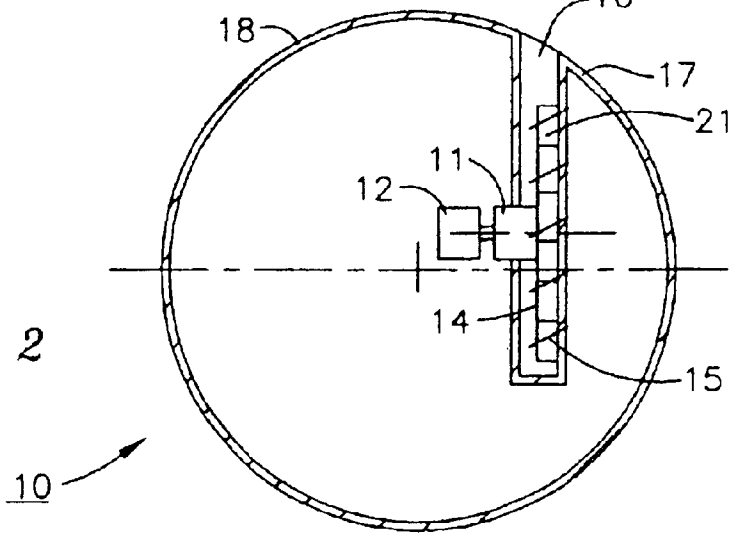
FIG. 2 is a cross-sectional view along the line 2—2 of FIG. 1.

Referring now to FIGS. 1 and 2, a missile or other similar launched device or ordnance 10 incorporates an actuator 12 and a shaft 11 to which is mounted a fin or similar steering device 14. While actuator 12 serves to drive the movement of fin 14, shaft 11 allows rotation of fin 14 about the various angles required for proper deployment and steering. In the pre-launch position represented in FIG. 1, fin 14 connected to actuator 12 via shaft 11 is located within a slot 16 in body 18 of missile 10. In this position, fin 14 is stowed longitudinally within body 18 and lies parallel to the longitudinal dimension of body 18. As can be seen in FIGS. 1 and 2, fin 14 is folded at hinge 21 proximate shaft 11 of actuator 12. Hinge 21 actually connects fin 14 to actuator 12 via shaft 11, and fin 14 is stowed/folded to a position perpendicular to actuator 12 and shaft 11 as depicted in FIGS. 1 and 2. In this stowed position spring 15 forces fin 14 against inner surface 17 of slot 16.

Figure 4:
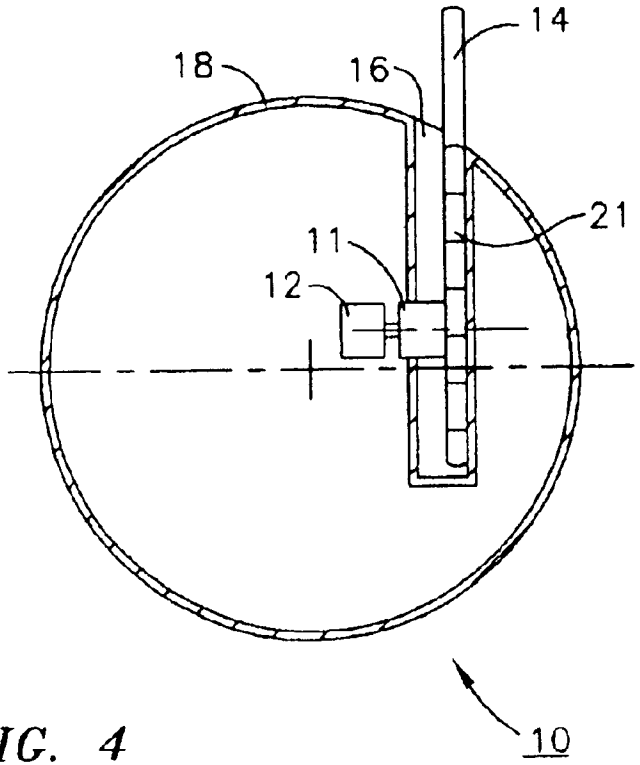
FIG. 4 is a cross-sectional view along the line 44 of FIG. 3.
Figure 3:
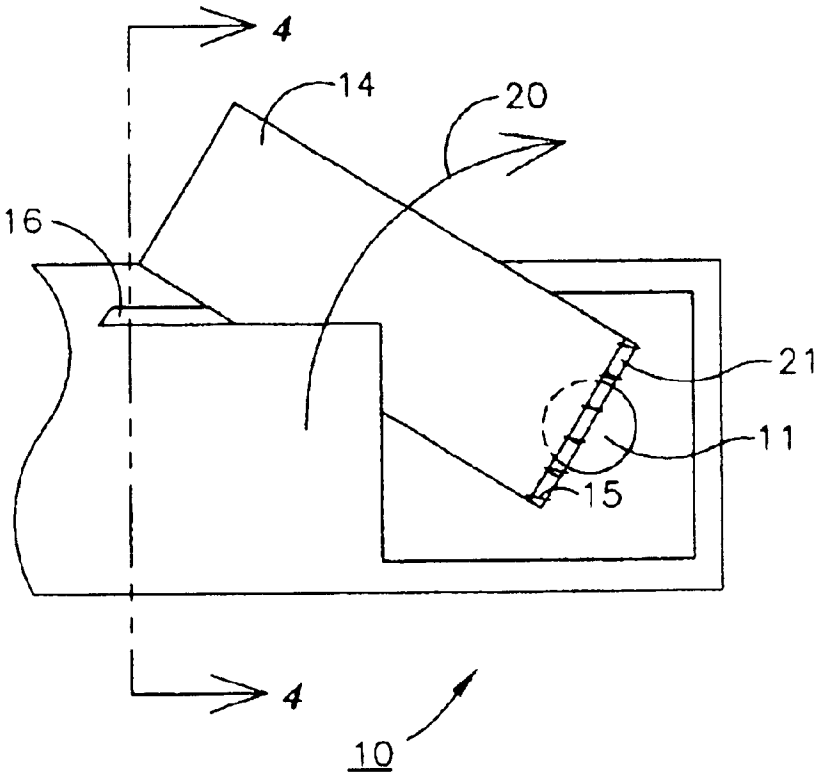
FIG. 3 is a schematic side view of a single fin emerging from a missile body prior to unfolding.
Figure 6:
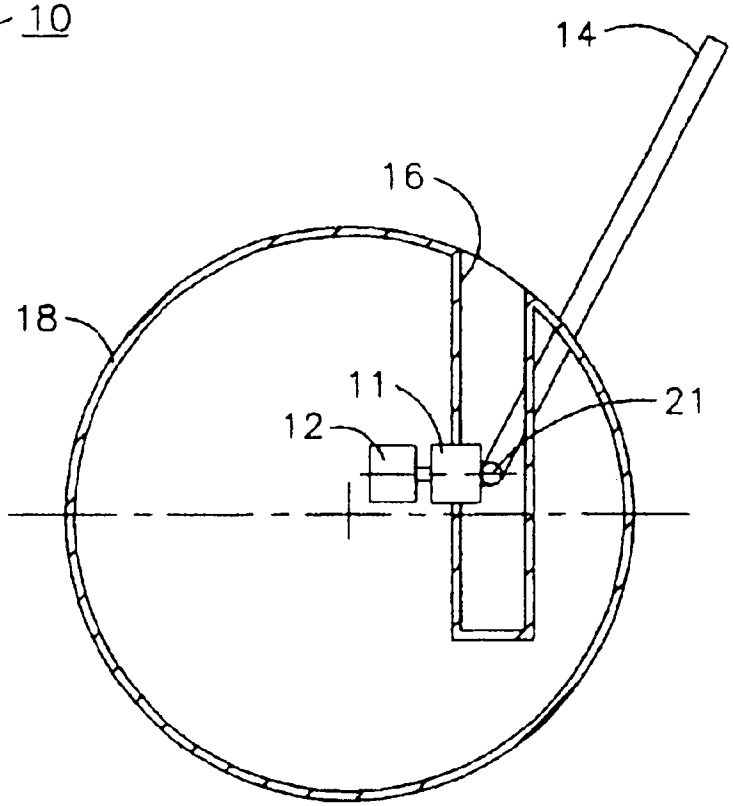
FIG. 6 is a cross-sectional view along the line 6—6 of FIG. 5.
Figure 5:
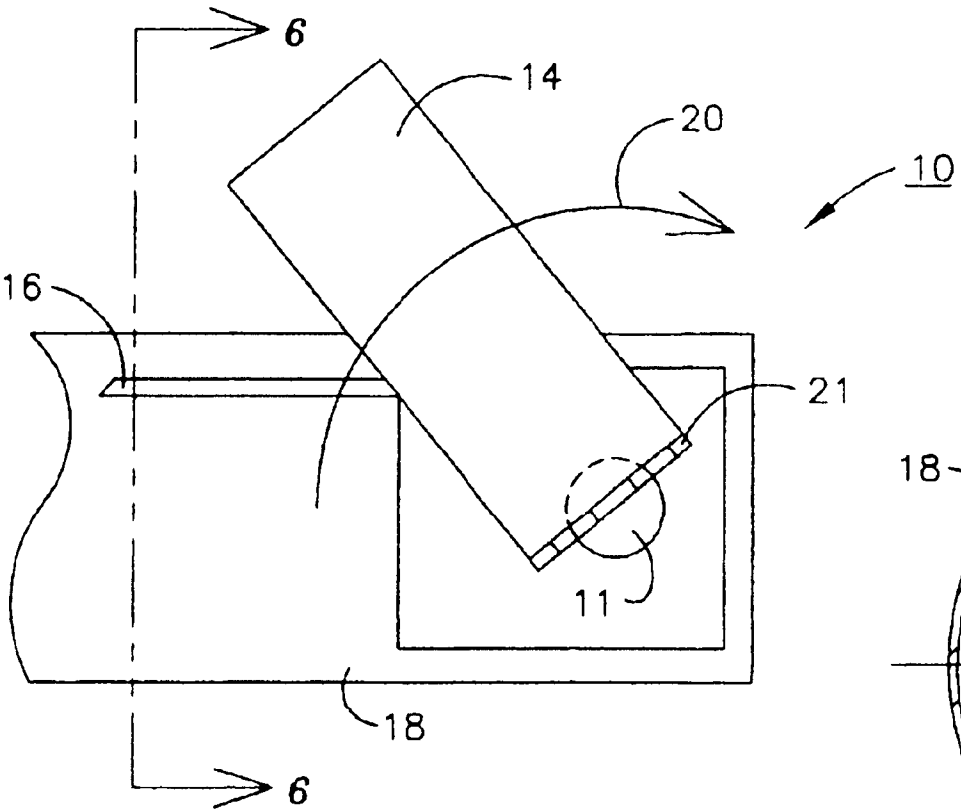
FIG. 5 is a schematic side view of a single fin as it emerges from the body of a missile and begins to unfold.
Figure 7:
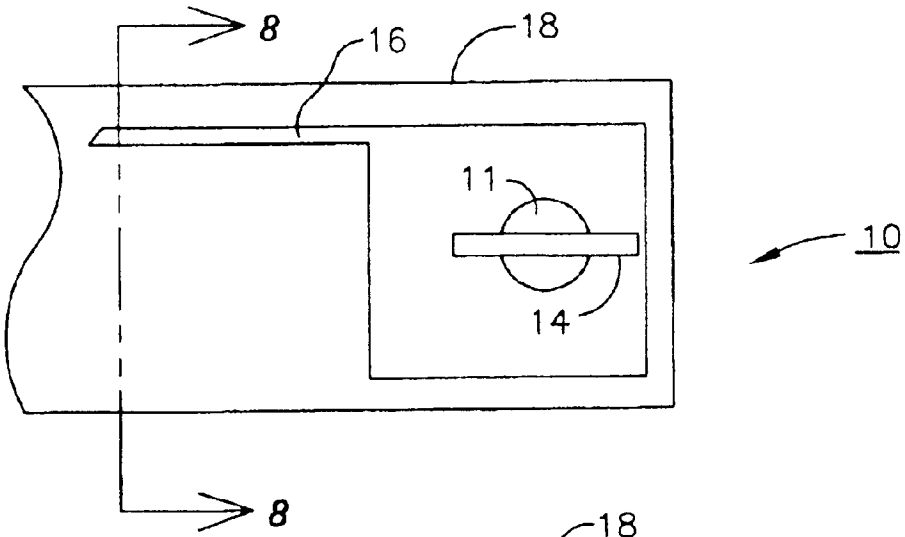
FIG. 7 is a schematic side view of a single fin in the fully deployed position.
Figure 8:
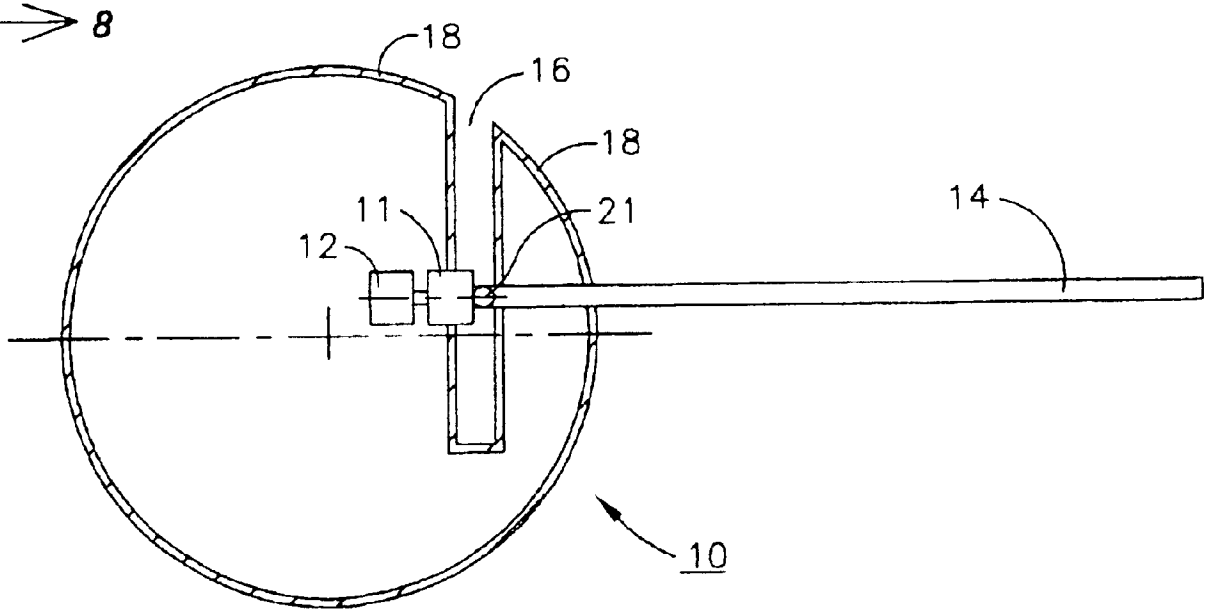
FIG. 8 is a cross-sectional view along the line 8—8 of FIG. 7.

As seen in FIGS. 3 and 4, upon the initiation of deployment, actuator 12 is used, via shaft 11, to rotate fin 14 longitudinally from its completely stowed position within slot 16 in body 18 toward the exterior of body 18 in the direction shown by arrow 20. For as long as fin 14 has not completely cleared slot 16, (see FIGS. 7 and 8) it remains in its folded configuration due to the contact between fin 14 and inner surface 17. It should be noted that surface 17 is preferably coated with a substance such as Teflon® or the like to render deployment of fin 14 easier. Any material that will ease the sliding of fin 14 over surface 17 may be used in this application. As activation/deployment continues, actuator 12 and shaft 11 further rotate fin 14 in the direction of arrow 20 from its fully stowed position (FIGS. 1 and 2) in slot 16, through its partially stowed positions (FIGS. 3, 4, 5 and 6) until fin 14 clears slot 16 entirely and spring 15 causes fin 14 to deploy by rotation about hinge 21 thereby causing fin 14 to achieve its full deployment perpendicular to the longitudinal dimension of body 18, as best seen in FIG. 8. In this position, actuator 12 via shaft 11 can rotate fin 14, thereby acting in its conventional manner to control the orientation of fin 14 and hence the flight path of missile 10. This control of the orientation of the plurality of individual fins 14 (shown in FIG. 11) thus provides directional delivery of missile 10 to its appointed target.

In use, missile 10 is fired and upon attainment of some preset condition, number of Gs, time since firing, altitude achieved, etc. actuator 12 is activated and the rotation sequence begun. Activation of actuator 12 and shaft 11 continues until fin 14 has achieved its full deployment as shown in FIG. 8. Actuator 12 via shaft 11 is then available to provide directional guidance to missile 10.

Figure 10:
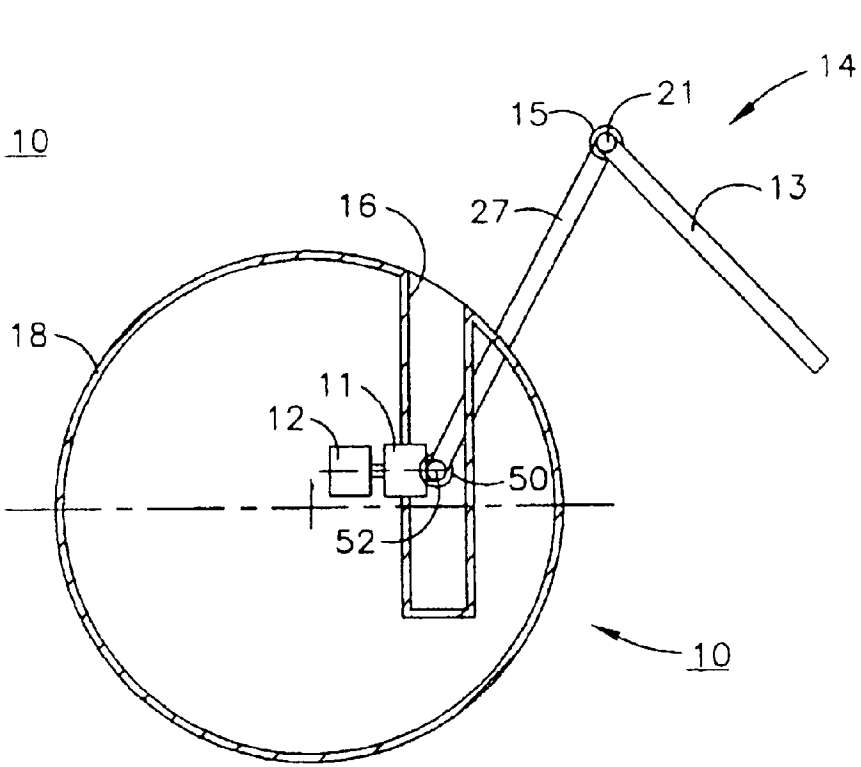
FIG. 10 is a cross-sectional view along the line 10—10 of FIG. 9.
Figure 9:
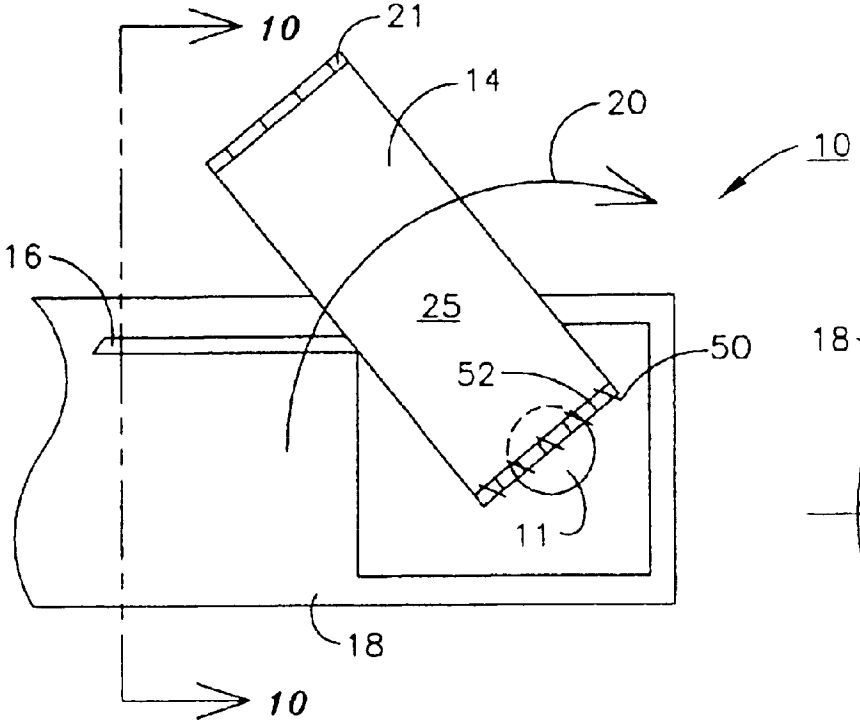
FIG. 9 is a schematic side view of an alternative embodiment of the fin deployment system of the present invention showing the fin in the partially deployed position.

As will be apparent to the skilled artisan, an additional combination of spring 50 and hinge 52 could also be located along the length of fin 14 at any point intermediate a first end 27 of fin 14 proximate actuator 12 and distal end 13 of fin 14 remote from actuator 12 as shown in FIGS. 9 and 10. In this configuration, fin 14 would fold at a location intermediate the first and distal ends 27 and 13 in addition to folding at the point of junction of fin 14 and actuator/shaft 12/11. The spring 15/50, hinge 21/52 combination(s) can be locked in place by means of a catch mechanism, as well known to those skilled in the art. Folding is accomplished by laying the outermost extremity of fin 14, the distal end 13, upon first end 27.

As the invention has been described, it will be apparent to those skilled in the art that the same may be varied in many ways without departing from the spirit and scope of the invention. Any and all such modifications are intended to be included within the scope of the appended claims.

What is claimed is:

1. A system for the deployment of guidance devices from the body of guided ordnance comprising:

A) a missile body having a longitudinal dimension;

B) a plurality of actuators in % aid body;

C) a plurality of fins about the periphery of said body each comprising:

I) a main body;

II) a first end proximate connected to one of said actuators via a shaft; and

III) a distal end remote from said first end;

each of said fins being capable of longitudinal rotation by the action one of said actuators on one of said shafts;

D) a plurality of slots equal in number to said fins, and parallel to said longitudinal dimension, each having an inner surface;

each of said fins being located in one of said slots and further including a hinge and a spring intermediate said distal end and said actuator, each of said springs serving to force rotation of one of said fins about said hinge and toward said inner surface, such that upon longitudinal rotation of said fins by said actuators to a point where said fin clears said slot, said spring forces said fin to deploy via rotation about said hinge.

2. The system of claim 1 wherein said spring is located at said first end proximate said shaft.

3. The system of claim 2 wherein said inner surface is proximate said body and said inner surface is coated with a substance that provides a sliding surface over which the distal end can slide.

4. The system of claim 1 including at least two of said fins.

5. The system of claim 1 wherein each of said fins further includes a second hinge and a second spring intermediate said first end and said distal end.

* * * * *